US005343790A

United States Patent [19]

Kuhrt

[11] Patent Number: 5,343,790

[45] Date of Patent: Sep. 6, 1994

[54] METHOD AND APPARATUS FOR SLICING ARTICLES OF FOOD AND THE LIKE

[75] Inventor: Darwin H. Kuhrt, Rice Lake, Wis.

[73] Assignee: Food Service Products Company, Oakland, Calif.

[21] Appl. No.: 914,681

[22] Filed: Jul. 15, 1992

[51] Int. Cl.[5] ..... B26D 1/16

[52] U.S. Cl. ..... 83/395; 83/444; 83/490; 83/602; 83/932

[58] Field of Search ..... 83/490, 395, 602, 411.2, 83/42, 23, 444, 932

[56] References Cited

U.S. PATENT DOCUMENTS

| | | | |
|---|---|---|---|
| 55,164 | 5/1866 | Roosevelt | 83/395 X |
| 126,116 | 4/1872 | Weed et al. | 83/202 |
| 131,127 | 9/1872 | Smith | 83/155 |
| 944,491 | 12/1909 | Madden | 83/395 |
| 1,594,996 | 8/1926 | Brown | 83/417 |
| 1,899,867 | 2/1933 | Heilinger | 83/555 |
| 2,166,648 | 7/1939 | Swofford | 83/165 |
| 2,224,557 | 12/1940 | Van Berkel | 83/490 X |
| 2,262,882 | 11/1941 | Bucklin | 83/89 |
| 2,332,013 | 10/1943 | Rudert et al. | 83/602 X |
| 2,513,741 | 7/1950 | Pinaud | 83/411.4 |
| 2,590,909 | 4/1952 | Westby et al. | 83/150 |
| 2,720,233 | 10/1955 | Hoag | 83/155 |
| 3,530,915 | 9/1970 | Moriuchi | 83/490 X |
| 3,760,715 | 9/1973 | Grote et al. | 99/450.1 |
| 3,783,727 | 1/1974 | Brignard et al. | 83/592 |
| 3,942,399 | 3/1976 | Giangiulio | 83/4 |
| 4,244,252 | 1/1981 | Pellaton | 83/356.3 |
| 4,299,150 | 11/1981 | Huston et al. | 83/110 |
| 4,341,136 | 7/1982 | Parson | 83/490 X |
| 4,598,620 | 7/1986 | Flammann | 83/399 |
| 4,852,441 | 8/1989 | Anders et al. | 83/395 |
| 4,960,025 | 10/1990 | Fitch | 83/411.2 X |
| 4,961,949 | 10/1990 | Barnes et al. | 426/518 |

FOREIGN PATENT DOCUMENTS

| | | | |
|---|---|---|---|
| 0251742 | 7/1988 | European Pat. Off. | B26D 7/34 |
| 2302943 | 9/1974 | Fed. Rep. of Germany | B26D 4/22 |
| 2749652 | 10/1979 | Fed. Rep. of Germany | B26D 4/32 |

*Primary Examiner*—Richard K. Seidel
*Assistant Examiner*—Kenneth E. Peterson
*Attorney, Agent, or Firm*—Burns, Doane, Swecker & Mathis

[57] ABSTRACT

In a method and machine for slicing articles of food and the like, the articles pass by gravity through generally vertical, spaced apart pairs of feed tubes mounted on a support structure. A table and rotary blade are arranged for oscillation between and past the spaced apart feed tubes, the table forming a stop surface for positioning the articles with the rotary blade slicing through the article positioned by the table. The table is adjustable relative to the blade for controlling slice thickness. The rotary blade and table are cantilevered from a single bearing shaft permitting oscillation of both units by a cam motor assembly and height adjustment of the table by a manual jack. Tripod support for the entire unit is provided by the bearing shaft and two adjustable legs.

21 Claims, 4 Drawing Sheets

FIG. 7
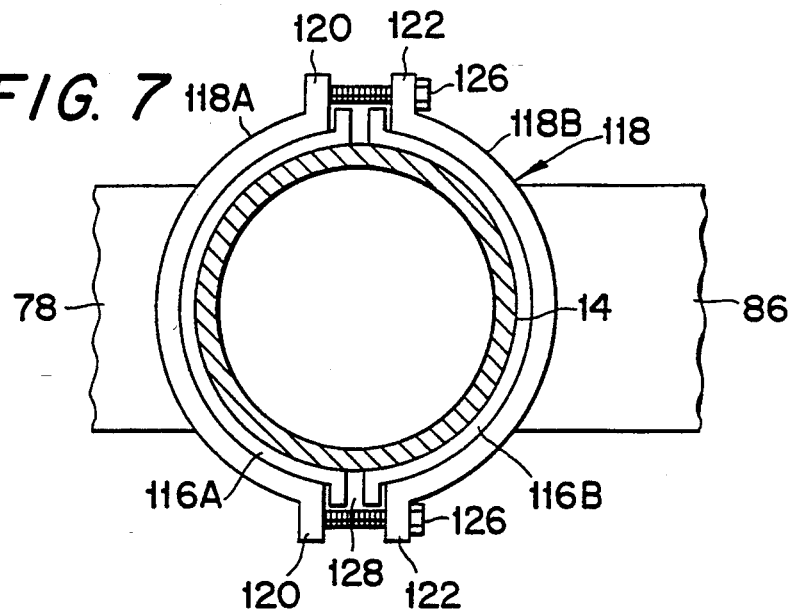
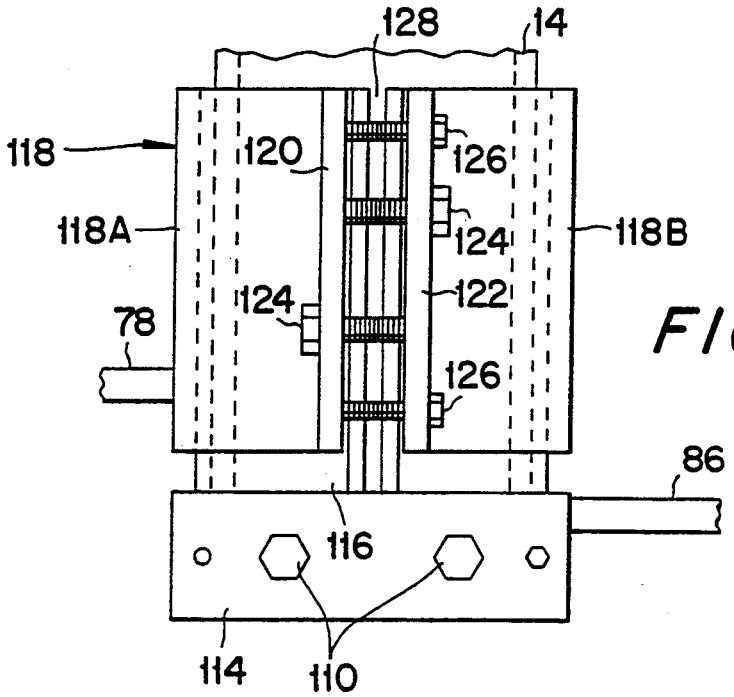
FIG. 6
FIG. 8
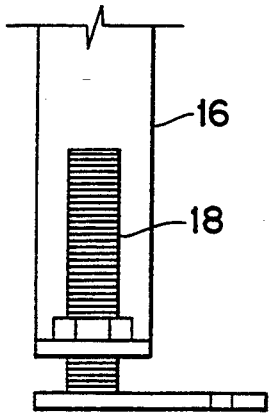

METHOD AND APPARATUS FOR SLICING ARTICLES OF FOOD AND THE LIKE

FIELD OF THE INVENTION

The present invention relates to a method and apparatus for slicing articles of food and the like and more particularly to a method and apparatus particularly contemplated for slicing food articles such as onions.

BACKGROUND OF THE INVENTION

A wide variety of slicing machines have been provided in the prior art for slicing various articles such as foods including vegetables, sausage sticks, frozen fish and the like.

These prior art slicing machines have generally been provided with one or more conveyers for supplying the articles to be sliced to a cutting station with cutting means such as a blade, saw or the like being provided for slicing the articles into slices of desired thickness.

Although these prior art devices have proven to be satisfactory for their intended purposes, there has been found to remain a need for further improvements in such slicing methods and apparatus.

SUMMARY OF THE INVENTION

Accordingly, it is an object of the present invention to provide an improved method and apparatus for slicing various articles, particularly foods such as vegetables including onions and the like with operating advantages over prior art devices such as those referred to above.

It is also a general object of the invention to provide such a method and apparatus for slicing various articles wherein the articles are sliced rapidly and accurately for a variety of applications.

More specifically, it is an object of the invention to provide a method and apparatus for slicing articles with a machine including a base structure, generally vertical feed tubes being spaced apart and each supplying articles by gravity flow onto a table mounted on the base structure for engaging and positioning the articles to be sliced, a rotary blade assembly being mounted for oscillation on the base structure with the table between the spaced apart feed tubes so that the blade passes back and forth between and respectively past each feed tube in order to slice an article from each feed tube as it is positioned on the table and means for collecting the slices.

Such a method and apparatus has been found to be particularly effective for rapidly slicing large numbers of articles such as food and the like. Preferably, the table is adjustably mounted for movement parallel to an axis of oscillation for the rotary blade assembly in order to selectively control slice thickness. In addition, a bearing column preferably supports both the blade assembly and table for oscillating travel and for adjustable movement of the table, the bearing column providing a triangular support for the base structure together with two additional legs.

More broadly, it is an object of the invention to provide a method and apparatus for slicing articles of food and the like wherein a slicing machine includes a base structure, spaced apart feed means for supplying articles to be sliced, stop means arranged adjacent each feed means for respectively engaging and positioning the articles from the feed means, a knife means being mounted on the base structure for oscillating travel between and respectively past the feed means in order to slice the articles while they are positioned by the stop means.

Preferably, the stop means are adjustably mounted for movement parallel to an axis of oscillation for the knife means in order to selectively control slice thickness. It is also preferable to provide the base structure with a bearing column for supporting the oscillating knife means and for adjustably supporting the stop means which are secured for oscillating travel with the knife means, each stop means having a lateral edge arranged adjacent a cutting edge of the knife means to form a passage for slices to pass therebetween into a suitable collector. Each feed means preferably comprises multiple feed devices so that multiple articles are substantially simultaneously sliced by the knife means.

Additional objects and advantages of the invention will be apparent from the following description having reference to the accompanying drawings.

BRIEF DESCRIPTION OF THE DRAWINGS

FIG. 6 is a fragmentary side view in elevation of one of a series of bearing units for supporting an oscillating table and rotary blade assembly on a common bearing column or shaft.

FIG. 7 is a top view of the collar unit of FIG. 6.

FIG. 8 is an enlarged, fragmentary view of an adjustable portion of one of the legs for the slicing machine.

BRIEF DESCRIPTION OF THE PREFERRED EMBODIMENT

Figure 1:
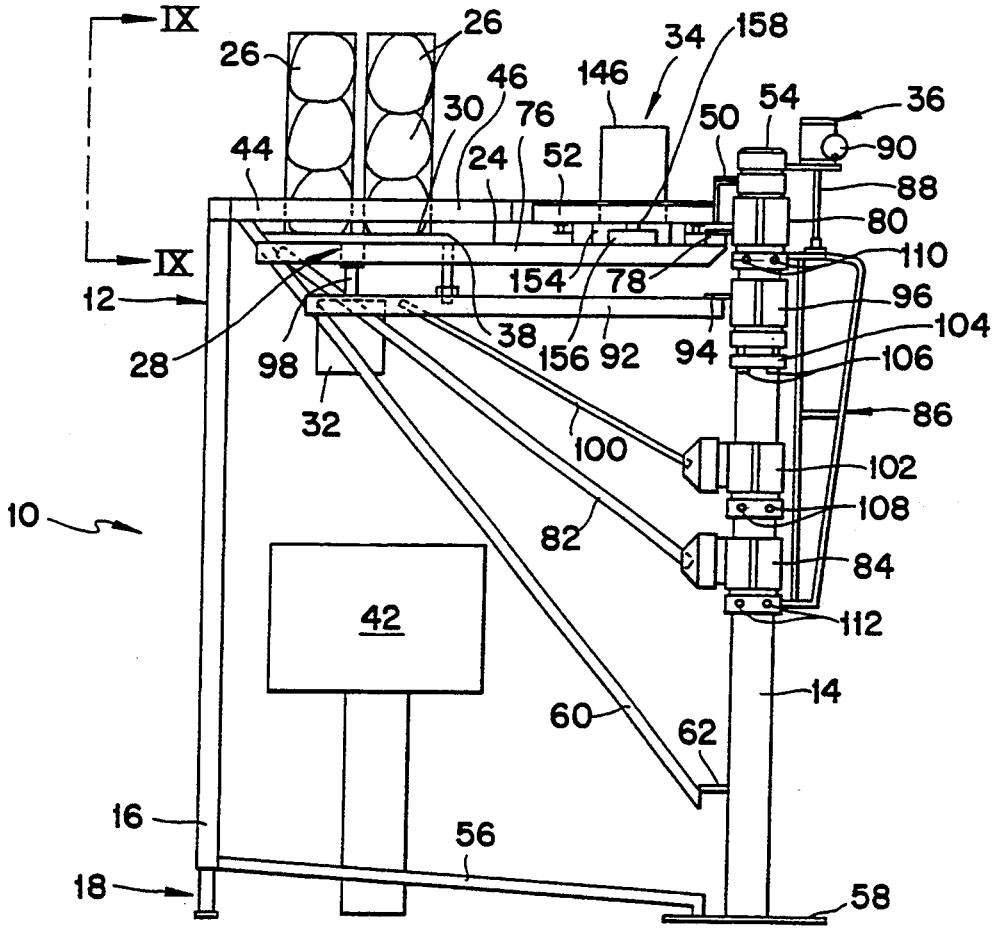
FIG. 1 is a side view in elevation of the slicing machine of the present invention.
Figure 2:
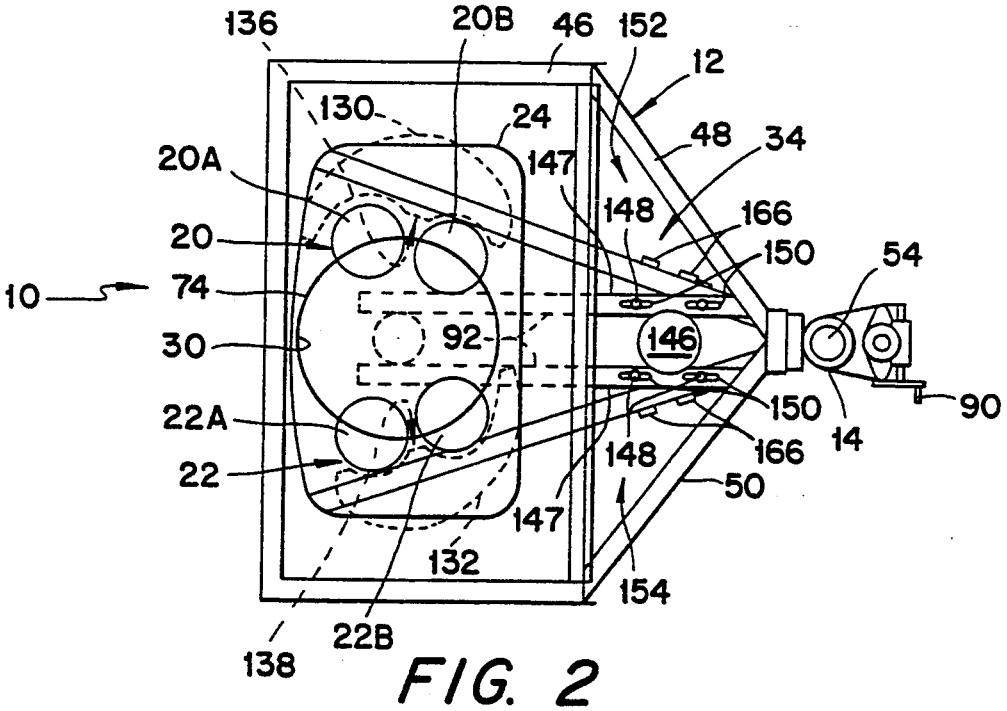
FIG. 2 is a plan view of the slicing machine of FIG. 1, the machine of FIGS. 1 and 2 also being effective for practicing the slicing method of the invention.

Referring now to the drawings and particularly to FIGS. 1 and 2 in combination, a machine for slicing articles of food and the like is generally indicated at 10. The slicing machine 10 illustrated in the figures is also particularly adapted for carrying out the slicing method of the present invention. As indicated above, both the machine 10 and the method contemplated for its operation are particularly adapted for slicing foods such as vegetables and more particularly for slicing onions. However, the machine 10 and its method of operation are also readily adaptable for slicing other food articles including additional vegetables and other diverse food articles, for example, salami, and the like. Although the machine and method of operation are particularly contemplated for slicing food products, it is of course also contemplated that both the method and machine may also be employed for slicing other articles as well.

Referring again particularly to FIGS. 1 and 2, the slicing machine 10 includes a support structure 12 mounted in tripod fashion on a bearing column or shaft 14 and two front legs 16, each including an adjusting screw 18 as better illustrated in FIG. 8 in order to level the support structure and to provide a firm and rigid support for the structure on a variety of surfaces (not shown).

The principal operating components of the slicing machine 10 include spaced apart feed stations 20 and 22. Preferably, each of the feed stations 20 and 22 includes a pair of generally vertically arranged feed tubes A and B.

A table 24 is arranged beneath the feed tubes 20A, 20B and 22A, 22B in order to provide a stop surface for positioning articles 26 supplied from the feed tubes.

A blade assembly 28 is arranged for oscillation between the feed stations 20 and 22 in a manner described in greater detail below in order to slice the articles 26 in a position established by the table 24.

The blade assembly 28 includes a circular blade 30 driven in rotation by a blade motor 32. A cam assembly 34 operates in a manner described in greater detail below for driving the blade assembly 28 together with the table 24 in oscillating fashion between the feed stations 20 and 22 in order to rapidly slice articles supplied from the feed tubes in a manner described in greater detail below.

The table 24 is adjustable along the axis of oscillation for the blade assembly 28 by means of a manually operated jack 36.

These basic components of the slicing machine 10 are described in greater detail below together with a method of operation typically carried out with the slicing machine 10. However, the brief summary of the basic components for the slicing machine 10 set forth above emphasizes the simplicity of the slicing machine 10 and its operation for rapidly and effectively slicing large numbers of articles of food and the like. Continuing with reference to FIGS. 1 and 2, the articles 26 (to be sliced) are supplied by gravity flow through the feed tubes 20A, 20B and 22A, 22B. The articles are positioned as they exit the feed tubes by the table 24 with the circular blade 30 oscillating back and forth between the feed stations 20 to rapidly reduce the articles into slices with a thickness established by spacing between a cutting edge 38 of the blade and stop surfaces 40 formed beneath all of the feed tubes (at least part of the time) by the table 24.

The blade assembly 28 and table 24 are then rapidly driven in oscillation by the cam assembly 34, the circular blade 30 being driven in rotation by the blade motor 32 to carry out the slicing method of the invention. As noted above, the height of the table 24 can readily be adjusted relative to the circular blade 30 in order to control slice thickness.

Article slices thus formed by the slicing machine 10, described in greater detail below, are then transferred to a suitable collector 42. The collector 42 may simply be a container as illustrated in FIG. 1. However, the collector 42 could also comprise either a packaging station (not shown) or a conveyor (not shown) for transferring the sliced articles to a further processing unit (also not shown).

The components of the slicing machine 10 as summarized above are described in greater detail below followed by a description of a method of operation for the slicing machine.

The support structure 12 is fabricated from rectangular tubing to form a support for a large rectangular cover 44. For this purpose, the support structure 12 includes the bearing shaft 14 and the two front legs 16 as well as a rectangular support structure 46 formed beneath the cover 44 by rigid tubing. Angled rectangular tubes 48 and 50 are secured to the rectangular support structure 46 for example by welding and are similarly interconnected with a bracket 52 secured generally adjacent the uppermost end 54 of the bearing shaft 14. The lower ends of the front legs 16 are respectively connected to struts 56 which are in turn secured to a base plate 58 for the bearing shaft 14.

The support structure 12 is rigidified by additional struts or braces 60 connected respectively to the upper ends of the front legs 16 and to a bracket 62 secured to the bearing shaft 14 just above the base plate 58. Thus the support structure 12 provides strong and rigid support for the components of the slicing machine 10 with the adjusting screws 18 on the two front legs 16 being adaptable for leveling the slicing machine on a variety of surfaces.

Figure 9:
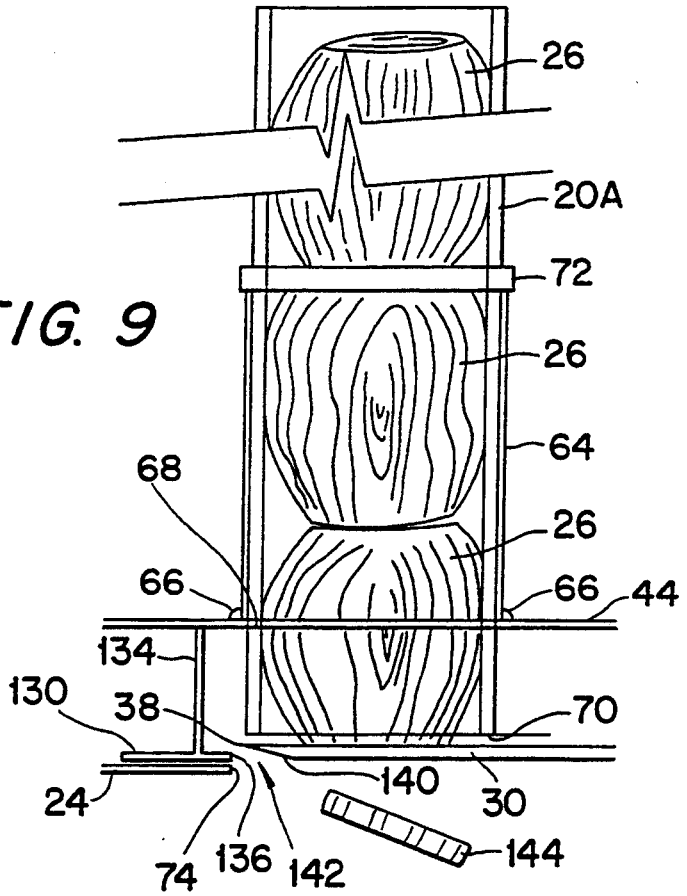
FIG. 9 is an enlarged fragmentary view taken along section line IX—IX in FIG. 1 and illustrating one lateral pair of feed tubes with adjacent portions of the rotary blade and table being illustrated generally at one oscillating limit of travel.
Figure 10:
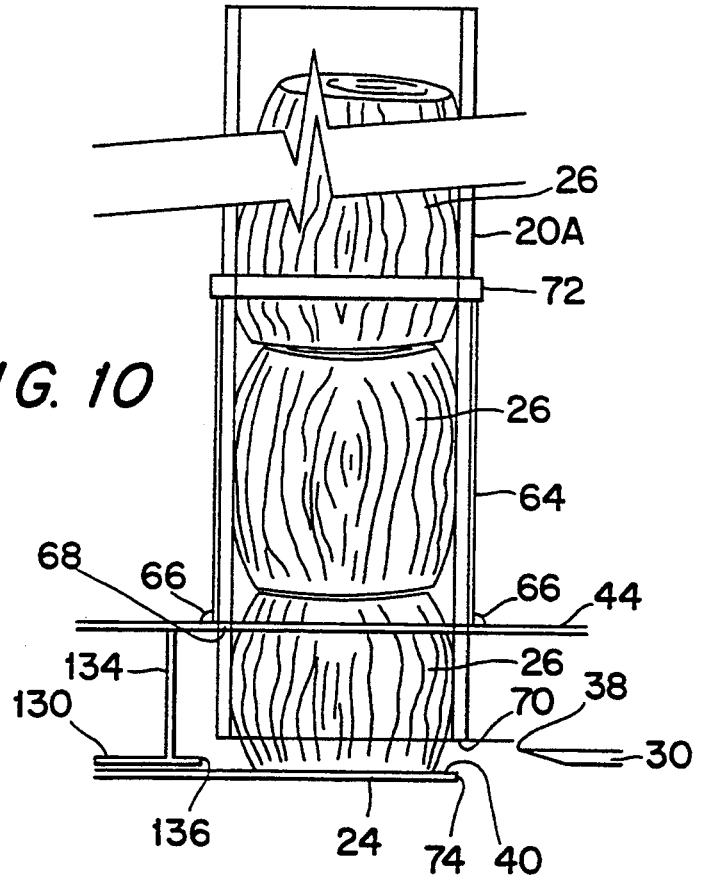
FIG. 10 is a view similar to FIG. 9 with the rotary blade and table in generally an opposite limit of oscillating travel.

The feed stations 20 and 22 are illustrated in FIGS. 1 and 2 with one of the feed tubes being illustrated in greater detail together with adjacent portions of the table and circular blade in FIG. 9 and 10. Referring momentarily also to FIGS. 9 and 10, each of the feed tubes, for example that indicated at 20A in FIGS. 9 and 10 comprises a metal cylindrical housing 64 welded at its base as indicated at 66 to the cover 44. The feed tube 20A nests within the cylindrical housing 64 and extends downwardly through an opening 68 in the cover 44 so that a lower end 70 of the feed tube 20A is positioned closely adjacent the circular blade 30 and the table 24 as described in greater detail below. The feed tube 20A is preferably molded with an annular collar 72 on its outer surface to rest upon the cylindrical housing 64 and accurately position the lower end 70 of the tube. The remaining features of FIGS. 9 and 10 are also described in greater detail below.

Referring again to FIGS. 1 and 2, the table 24 is generally rectangular with a circular opening 74 about the same diameter as the circular blade and preferably slightly larger to form lateral edges adjacent the cutting edge 38 of the blade. The importance of the lateral edge formed by the circular opening 74 in combination with the circular blade 30 is also described in greater detail below with reference to FIGS. 9 and 10.

The table 24 is supported by rectangular tubes 76 secured to a bracket 78 on the bearing shaft 14 and extending angularly beneath the table 24 as illustrated in FIGS. 1 and 2 in combination. The bracket 78 is secured to a first collar unit 80 adjustably mounted on the bearing shaft 14 just below the bracket 52 for the support structure 12 and cover 44. Struts 82 are secured to the angularly extending ends of the rectangular tubes 76 and to a fourth or lowermost collar unit 84 also adjustably positioned upon the bearing shaft 14.

The first and fourth collar units 80 and 84 are interconnected by an elongated arm assembly 86 extending parallel to the bearing shaft 14 and interconnected to a rod 88 extending downwardly from the manually operated jack 36. With this arrangement, the jack 36 is operated by a manual crank 90 for raising and lowering both of the collar units 80 and 84 on the bearing shaft 14 and thereby raising and lowering the table 24. As will also be made more apparent in the following description relative to FIGS. 9 and 10, adjustment of the table height relative to the circular blade 30 serves to adjust slice thickness.

Additional rectangular tubes 92 extend leftwardly from a bracket 94 on a second collar unit 96, as seen in FIG. 1, to provide a support for the blade motor 32. A drive shaft 98 extends upwardly from the blade motor 32 through the opening 74 in the table 24 to rigidly support and drive the circular blade 30 in rotation. Struts 100 extend from the outer ends of the rectangular tubes 92 downwardly for interconnection with a third collar unit 102. Accordingly, the second collar unit 96 and the third collar unit 102 serve to provide a rigid support for the blade motor 32 and accordingly the circular blade 30. The second collar unit 96 and third collar unit 102 are rigidly secured to the bearing shaft 14 in order to position the height of the circular blade. However, adjustment for the second collar unit 96 is provided in order to permit adjustment of the height of the circular blade 30 to compensate for wear or the like.

For that purpose, another collar 104 is rigidly secured to the bearing shaft 14 just below the second collar unit 96, for example by means of generally horizontally arranged set screws (not shown). Additional set screws 106 are threaded vertically through the fixed collar 104 to engage the bottom of the second collar unit 96 and establish its height on the bearing shaft 14. This in turn serves to fix the height of the blade assembly 28 and particularly the circular blade 30 relative to the bearing shaft 14. Additional set screws similar to those indicated at 106 are provided on the opposite side of the beating shaft 14 to provide better support for the second collar unit 96.

The position of the third collar unit 102 on the beating shaft 14 is secured by means of set screws 108.

The first collar unit 80 and the fourth collar unit 84 are preferably positioned upon the bearing shaft 14 by the manual jack 36 as described above. However, those collar units are also provided with set screws respectively indicated at 110 and 112. Preferably, the set screws 110 and 112 are not employed when the first and fourth collar units are being positioned by the jack 36. However, the set screws 110 and 112 may be employed for securing the respective collar units in place upon the bearing shaft 14 following adjustment by the jack 36.

The four collar units 80, 96, 102 and 84 are of generally similar construction except for their interconnecting brackets as described in greater detail above. Accordingly, the construction of one of the collar units, for example the first collar unit 80, is illustrated in greater detail in FIGS. 6 and 7. As noted above, it is to be understood that the remaining collar units are of similar construction.

Referring momentarily to FIGS. 6 and 7, the first collar unit 80 includes a set collar 114 which is positioned upon the beating shaft 14 either by the elongated arm assembly 86 or by the set screws 110 as described in greater detail above. A split sleeve 116 formed from an ultra high molecular weight polymer such as polyethylene or nylon surrounds the bearing shaft 14 just above the set collar 114 and in turn positions a split collar assembly 118. The split collar assembly 118 comprises two split collars 118A and 118B of similar construction. Both of the split collars are flanged with facing flanges 120 and 122 on the split collars 118A and 118B arranged in facing relation and secured together by bolts 124. Set screws 126 are threaded through one of the flanges, for example that indicated at 122 and abut a surface in the opposite flange 120 in order to maintain a gap 128 between the flanges 120 and 122 in order to assure proper fit for the split collar assembly 118 on the bearing shaft 14. As illustrated in FIG. 7, a similar arrangement of flanges and bolts is provided on the opposite side of the bearing shaft 14. Referring also to FIG. 1, the flange 78 from which the rectangular tubes 76 extend for supporting the table 24 is also secured to the split collar 118A.

The split elastomeric sleeve 116 is formed with split axial extensions 116A and 116B underlying the respective split collar elements 118A and 118B. Accordingly, the elastomeric sleeve 116 serves to support the collar unit 80 for oscillatory motion on the beating shaft 14 while also serving as a thrust bearing for axially positioning the collar unit 80 on the bearing shaft 14.

As noted above, the remaining collar units are of similar construction except for the brackets or other components to which they are connected.

Operation of the cam assembly 34 is important for proper operation of the slicing machine 10 and its method of operation together with the configuration and mounting of the blade assembly 28 and table 24. Operation of the cam assembly 34 for controlling oscillating movement of the blade assembly 28 and table 24 is initially described with particular reference to FIGS. 1 and 2. Thereafter, oscillation of the blade assembly and table is described relative to other components of the slicing machine, especially the feed tubes, having particular reference to FIGS. 9 and 10.

In conjunction with the above components, it is also noted that guides or shoes 130 and 132 are mounted outside of each feed station 20 and 22. More particularly, each of the shoes 130 and 132 is suspended from the cover 44 by a strut 134 so that the shoe is positioned generally between the cutting edge 38 of the circular blade and the table 24 as illustrated for example in FIG. 2 and in FIGS. 9 and 10. Inner surfaces 136 and 138 of the shoes 130 and 132 arcuately surround both of the feed tubes in each of the feed stations 20 and 22. With the shoes configured and mounted as described above, they serve to assure that slices severed from the articles 26 by the circular blade 30 pass downwardly and inwardly, as viewed for example in FIG. 9, toward the collector 42.

Referring also to FIG. 9, the cutting edge 38 of the circular blade 30 is formed by an annular taper 140 arranged in facing relation with the opening or lateral edge 74 on the table 24. Accordingly, the cutting edge 38 and the annular taper 140 interact with the lateral edge 74 to form a passage 142 through which article slices pass after being severed by the blade 30. The shoes 130 and 132 assure that the slices, one of which is indicated at 144 in FIG. 9, pass downwardly through the passage 142 toward the collector 42. As may be seen in FIGS. 9 and 10 together with FIGS. 1 and 2, the circular opening 74 and circular blade 30 provide a similar combination of the cutting edge 38, the lateral edge 74 and the passage 142 adjacent the other feed station 22 (see FIG. 2).

Figure 3:
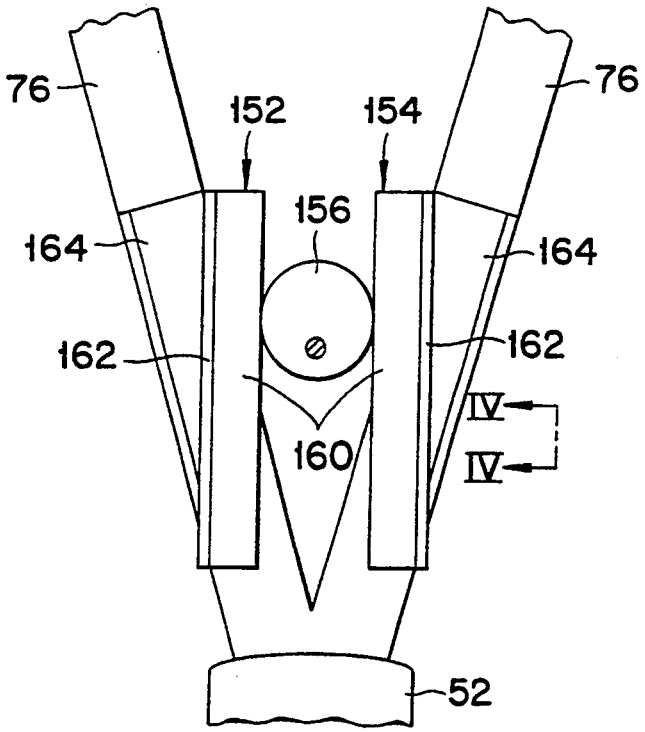
FIG. 3 is a view taken along section line III—III of FIG. 1 to illustrate a cam arrangement for oscillating the table and rotary blade assembly.
Figure 4:
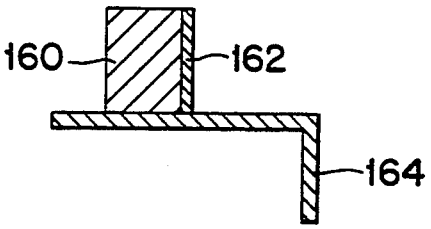
FIG. 4 is a view taken along section line IV—IV of FIG. 3 and illustrating an end view of one cam plate in the cam assembly.
Figure 5:
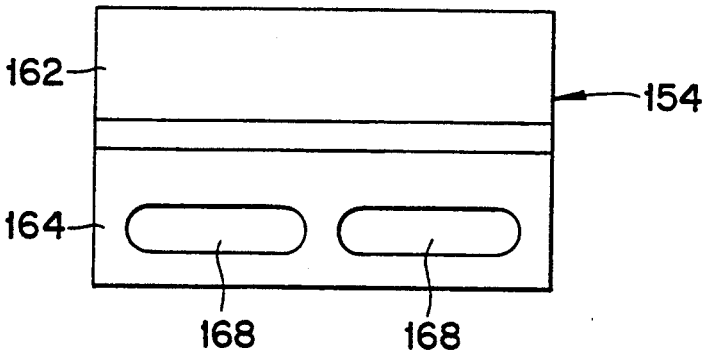
FIG. 5 is a side view of the cam plate of FIG. 4.

Referring particularly to FIGS. 1 and 2 in combination with FIGS. 3–5, the cam assembly 34 includes a cam motor 146 secured by bolts 148 extending through slots 150 in the rectangular tubes 147 secured to the bracket 52 and rectangular tubes 46 supporting the cover 44. Thus, the cam motor 146 can be shifted back and forth along the rectangular tubes 46.

Reaction cam plates 152 and 154 are mounted on the rectangular tubes 76 which support the table. The reaction cam plates 152 and 154 are also positioned for interaction with an offset cam 156 driven by a shaft 158 from the cam motor 146.

The reaction cam plates 152 and 154 have a wedge configuration extending further inwardly from the rectangular tubes 76 at their opposite ends from the bearing shaft 14.

Referring particularly to FIGS. 3–5, each of the reaction cam plates 152 and 154 includes a reaction pad 160 secured to a plate 162 formed at an angle with reference to a base plate 164 attaching to the respective rectangular tube 76. The reaction pads 160 are formed from ultra high molecular weight elastomeric material such as nylon or polyethylene in order to provide a proper reaction surface for the offset cam 156. The base plates 164 of the reaction cam plates 152 and 154 have slots 168 through which bolts 166 pass for attachment to the rectangular tube 76. Accordingly, the reaction cam plates 152 and 154 can be shifted longitudinally along the respective rectangular tube 76.

Through this arrangement of the cam assembly 34, the reaction cam plates 152 and 154 can be shifted on the rectangular tube 76 in order to compensate for wear between the offset cam 156 and the reaction pads 160 or to adjust the oscillating stroke of the blade assembly 28 and table 24 in either or both directions of oscillating travel as may be seen in FIG. 2 and as is described below in greater detail with reference to FIGS. 9 and 10. At the same time, the cam motor 146 may also be adjusted on the rectangular rails or tubes 46 for the same purpose.

With the above features in mind, oscillating operation of the blade assembly and table is now described with reference to FIGS. 9 and 10.

Referring initially to FIG. 9, the table 24 and blade assembly (represented by the circular blade 30) are illustrated at a leftward limit of oscillation as viewed in FIG. 9. At this position, the lateral edge 74 of the table is generally adjacent the inner edge of the shoe 130 and a portion of the cutting edge 38 has also passed completely under the feed tube 20A in order to cut completely through an article 26, the article slice 144 being severed from the article 26 at the bottom of the feed tube 20A. The shoe 130 prevents the article slice 144 from passing outwardly above the table 24 and assures that it moves inwardly through the passage 142 and toward the collector 42.

A rightward limit of oscillating travel is illustrated in FIG. 10 also having reference to the plan view of FIG. 2. As the circular blade 30 and table 24 oscillate rightwardly from the position of FIG. 9 toward the position of FIG. 10, the cutting edge portion indicated at 38 is positioned inwardly of the feed tube 20A (and also the feed tube 20B) with the table 24 being positioned directly beneath the feed tube 20A (and the feed tube 20B). In that position, the upper stop surface 40 of the table 24 engages and positions the bottommost article 26 in the feed tube 20A prior to the blade 30 again oscillating toward the left as viewed in FIGS. 9 and 10.

Thus, the blade and table tend to oscillate between a position illustrated in FIG. 10 where a bottommost article 26 in the feed tube 20A is positioned against the stop surface 40 of the table 24. As the cutting edge 38 of the blade then oscillates under and past the feed tube 20A, it slices through the lowermost article 26 in spaced apart relation from the stop surface 40 on the table 24.

Thus, the vertical position of the table 24, controlled by the manual jack 36 serves to precisely control slice thickness.

Oscillation of the blade assembly and table continue as described above with reference to FIGS. 9 and 10 so that slicing motion alternately occurs in the feed stations 20 and 22 (see FIG. 2).

Operation of the slicing machine 10 is believed to be apparent from the preceding description. However, the method of operation for the slicing machine is briefly described below in order to assure a complete understanding of the invention.

With the slicing machine 10 arranged as described above, the vertical position of the table is adjusted by the manual jack 36 so that slice thickness is established by the spacing between the cutting edge 38 of the blade 30 and the stop surface 40 of the table 24.

Articles 26 to be sliced, comprising either food such as a vegetable, more specifically an onion, or other similar articles, are then introduced into the feed tubes 20A, 20B and 22A, 22B so that they flow downwardly into engagement either with the stop surface 40 of the table or with an upper surface of the circular blade 30. With the cam motor and cam plates of the cam assembly 34 being adjusted to control oscillating limits, the cam motor 146 is operated for continually oscillating the blade assembly 28 and table 24 as described above. During this operation, articles from the feed tubes pass downwardly into engagement with the upper stop surface on the table 24. Oscillating travel of the blade 30 in one direction or the other then severs slices from the article with slice thickness being established by spacing between the cutting edge 38 of the blade and the stop surface 40 of the table.

Article slices 144 are caused by the shoes 130 and 132 to move inwardly through the passages 142 and into the collector 42.

Oscillating travel of the blade assembly 28 and the table 24 are continued as long as a supply of articles 26 is available in the feed tubes.

Adjustments may be made as necessary to assure proper operation of the slicing machine. For example, the height of the table 24 can be adjusted as described above for controlling slice thickness. At the same time, the position of the cam motor 146 and the reaction cam plates 152 and 154 can be adjusted on their respective rectangular tubes or rails in order to adjust or control the oscillating limits for the blade assembly and table.

Accordingly, there has been described a method and apparatus for slicing articles of food and the like in a rapid, efficient manner. Various modifications and additions will be obvious besides those specifically noted above. Accordingly, the scope of the present invention is defined only by the following appended claims which are further exemplary of the invention.

What is claimed is:

1. A machine for slicing articles, comprising a base structure, multiple feed tube stations, each station including a plurality of generally vertically arranged feed tubes for supplying articles by gravity flow, a table mounted on the base structure beneath the feed tube stations for engaging and positioning the articles to be sliced, a rotary blade assembly mounted on the base structure and comprising a rotary blade arranged generally horizontally just above the table, the multiple feed tube stations being respectively arranged on opposite sides of the rotary blade assembly for supplying articles to be substantially simultaneously sliced at each feed tube station by the rotary blade assembly, means for driving the rotary blade in rotation, means mounted on the base structure and operatively coupled with the table and rotary blade assembly for oscillating both the table and rotary blade, the blade oscillating between and respectively past each feed tube station whereby articles from the feed tubes are sliced as they are positioned by the table, and means for collecting the article slices.

2. The slicing machine of claim 1 wherein the table is adjustably mounted for movement parallel to an axis of oscillation for the rotary blade assembly in order to selectively control slice thickness.

3. The slicing machine of claim 2 wherein the base structure comprises a bearing column for supporting the oscillating and rotary blade assembly and for adjustably supporting the table, the table and rotary blade assembly being secured together for oscillating travel, the table having a lateral edge arranged adjacent a cutting edge of the rotary blade to form a passage for slices therebetween.

4. The slicing machine of claim 3 further comprising two additional legs for the base structure in order to provide a triangular support together with the bearing column.

5. The slicing machine of claim 1 wherein the means for oscillating the table and rotary blade assembly comprises a cam motor assembly mounted on the base structure.

6. The slicing machine of claim 5 wherein the cam motor assembly comprises adjustment means for controlling the oscillating stroke of the table and rotary blade assembly and to compensate for wear.

7. The slicing machine of claim 1 wherein the table forms an edge arranged adjacent a cutting edge of the rotary blade to form a passage for slices therebetween, the cutting edge being formed on the rotary blade by a taper facing the table whereby the taper urges each slice through the passage and toward the collecting means.

8. The slicing machine of claim 7 further comprising guide means fixedly mounted on the base structure respectively adjacent the feed tubes and adjacent an oscillating stroke limit for the rotary blade for forcing each slice through the passage between the rotary blade and table.

9. The slicing machine of claim 1 wherein the table has a circular opening formed therein, the circular opening being about the same size as the rotary blade, the circular opening forming an edge adjacent a cutting edge of the rotary blade to form a passage for slices therebetween.

10. The slicing machine of claim 9 wherein the cutting edge is formed on the rotary blade by a taper facing the table whereby the taper urges each slice through the passage and toward the collecting means.

11. The slicing machine of claim 10 further comprising guide means fixedly mounted on the base structure respectively adjacent the feed tube stations and adjacent an oscillating stroke limit for the rotary blade assembly for forcing each slice through the passage between the rotary blade and table.

12. A machine for slicing articles of food comprising a base structure, multiple feed tube stations spaced apart from each other, each station including a vertically arranged feed tube for supplying by gravity flow articles to be sliced, stop means arranged adjacent each feed tube station respectively engaging and positioning the articles from the feed tubes wherein the stop means are formed by a table having a circular opening therein, the circular opening being about the same size as the circular blade and forming an edge adjacent a cutting edge of the knife means to form a passage for slices therebetween.

knife means mounted on the base structure for oscillating travel between and respectively past the spaced apart feed tube stations in order to slice the articles while they are positioned by the stop means, and means for driving the knife means in oscillation.

13. The slicing machine of claim 12 wherein the stop means are adjustably mounted for movement parallel to an axis of oscillation for the knife means in order to selectively control slice thickness.

14. The slicing machine of claim 13 wherein the base structure comprises a bearing column for supporting the oscillating knife means and for adjustable supporting the stop means, the stop means and knife means being secured together for oscillating travel, the stop means having an edge adjacent a cutting edge of the knife means to form a passage for slices therebetween and collector means for receiving the slices.

15. The slicing machine of claim 14 wherein the oscillating knife means comprises a circular blade with the cutting edge about its periphery and motor means for driving the circular blade in rotation.

16. The slicing machine of claim 12 wherein each feed tube station includes multiple feed tubes for respectively supplying articles against the stop means for being sliced by the knife means.

17. The slicing machine of claim 16 wherein the feed tubes comprise generally vertical tubes for delivering articles to be sliced by gravity flow, the knife means oscillating in a generally horizontal plane and the stop means forming generally horizontal surfaces for positioning the articles to be sliced by the knife means.

18. A machine for slicing articles of food comprising a base structure, multiple feed tube stations spaced apart from each other, each station including a vertically arranged feed tube for supplying by gravity flow articles to be sliced, stop means arranged adjacent each feed tube station for respectively engaging and positioning the article from the feed tubes wherein the stop means are formed by a table having a circular opening therein, the circular opening being about the same size as the circular blade, knife means mounted on the base structure for oscillating travel between and respectively past the spaced apart feed tube stations in order to slice the articles while they are positioned by the stop means, the knife means comprising a circular blade with the cutting edge about its periphery and motor means for driving the circular blade in rotation, and means for driving the knife means in oscillation.

19. The slicing machine of claim 18 wherein the stop means is mounted for oscillating travel with the knife means, the stop means having an edge adjacent a cutting edge of the knife means to form a passage for slices therebetween and collector means for receiving the slices.

20. The slicing machine of claim 18 wherein the cutting edge is formed on the knife means by a taper facing the stop means, the taper urging each slice through the passage and toward collector means.

21. The slicing machine of claim 18 further comprising guide means fixedly mounted on the base structure adjacent each feed means and adjacent an oscillating stroke limit for the knife means for engaging each slice and forcing it through the passage between the knife means and stop means.

* * * * *